US012565696B2

(12) United States Patent
Bertalan et al.

(10) Patent No.: US 12,565,696 B2
(45) Date of Patent: Mar. 3, 2026

(54) TUNGSTEN CARBIDE-BASED CEMENTED HARD MATERIAL

(71) Applicant: CERATIZIT Luxembourg S.a.r.l., Mamer (LU)

(72) Inventors: Claudio Bertalan, Mamer (LU); Ralph Useldinger, Mamer (LU); Rolf Koesters, Mamer (LU)

(73) Assignee: CERATIZIT Luxembourg S.a.r.l., Mamer (LU)

( * ) Notice: Subject to any disclaimer, the term of this patent is extended or adjusted under 35 U.S.C. 154(b) by 688 days.

(21) Appl. No.: 17/778,511

(22) PCT Filed: Oct. 13, 2020

(86) PCT No.: PCT/EP2020/078715
§ 371 (c)(1),
(2) Date: May 20, 2022

(87) PCT Pub. No.: WO2021/099029
PCT Pub. Date: May 27, 2021

(65) Prior Publication Data

US 2022/0411904 A1 Dec. 29, 2022

(30) Foreign Application Priority Data

Nov. 22, 2019 (EP) ..... 19210812

(51) Int. Cl.
*C22C 29/08* (2006.01)
*B22F 1/054* (2022.01)
*B22F 5/00* (2006.01)

(52) U.S. Cl.
CPC ..... *C22C 29/08* (2013.01); *B22F 1/054* (2022.01); *B22F 2005/002* (2013.01);
(Continued)

(58) Field of Classification Search
None
See application file for complete search history.

(56) References Cited

U.S. PATENT DOCUMENTS 5,305,840 A * 4/1994 Liang ..... E21B 10/52 175/375
6,086,650 A 7/2000 Carpenter
(Continued)

FOREIGN PATENT DOCUMENTS

CN 106399796 A 2/2017
EP 1413637 A1 4/2004
(Continued)

OTHER PUBLICATIONS

English translation of JP 2016098393 (originally published May 30, 2016), obtained from PE2E search.*
(Continued)

*Primary Examiner* — George Wyszomierski
(74) *Attorney, Agent, or Firm* — Laurence A. Greenberg; Werner H. Stemer; Ralph E. Locher

(57) ABSTRACT

A tungsten-carbide-based hard material includes the following components: tungsten carbide with an average particle size of 0.1-1.3 μm; 1.0-5.0 wt. % (Co+Ni), with a ratio of Co/(Co+Ni) in wt. % of 0.4≤Co/(Co+Ni)≤0.95; 0.1-1.0 wt. % Cr, with a ratio of Cr to (Co+Ni) in wt. % of 0.05 Cr/(Co+Ni) 0.20; 0.01-0.3 wt. % Mo; and 0.02-0.45 wt. % Me, where Me represents one or more elements from the group Ta, Nb, Hf and Ti, preferably Ta and/or Nb; and wherein 0.01≤Me/(Co+Ni)≤0.13.

17 Claims, 5 Drawing Sheets

EXAMPLE 1

(52) U.S. Cl.
CPC ..... *B22F 2301/15* (2013.01); *B22F 2301/205* (2013.01); *B22F 2302/10* (2013.01); *B22F 2303/01* (2013.01); *B22F 2303/05* (2013.01); *B22F 2304/056* (2013.01); *B22F 2304/058* (2013.01)

(56) References Cited

U.S. PATENT DOCUMENTS

| | | | | |
|---|---|---|---|---|
| 6,241,799 | B1 * | 6/2001 | Galli | C22C 32/00 75/242 |
| 6,878,181 | B2 | 4/2005 | Carpenter | |
| 9,127,335 | B2 | 9/2015 | Ederyd | |
| 2002/0059849 | A1 | 5/2002 | Perez et al. | |
| 2008/0276544 | A1 | 11/2008 | Hirose et al. | |
| 2012/0093597 | A1 * | 4/2012 | Ederyd | C22C 29/08 72/274 |
| 2012/0210822 | A1 * | 8/2012 | Konyashin | C22C 1/051 977/773 |
| 2019/0358707 | A1 * | 11/2019 | Garcia | B22F 3/1017 |
| 2022/0002846 | A1 * | 1/2022 | Lavigne | C22C 29/067 |

FOREIGN PATENT DOCUMENTS

| | | | |
|---|---|---|---|
| EP | 1803830 | A1 | 7/2007 |
| EP | 2425028 | B1 | 10/2017 |
| JP | H08218145 | A | 8/1996 |
| JP | 2016098393 | A | 5/2016 |
| JP | 2017179474 | A | 10/2017 |
| JP | 2018070987 | A | 5/2018 |
| WO | 0000655 | A1 | 1/2000 |
| WO | 0131075 | A1 | 5/2001 |
| WO | 2019096539 | A1 | 5/2019 |

OTHER PUBLICATIONS

English translation of WO 20190956539 (originally published May 23, 2019), obtained from PE2E search.*

Hv10 Hra, "Rockwell A to Vickers HV30 Hardness", Jan. 1, 1810 (Jan. 1, 1810), Abgerufen von: URL:https://generalcarbide.com/assets/pdf/GCVickersHardness.pdf XP055697352.

* cited by examiner

COMPARATIVE EXAMPLE 1

EXAMPLE 1

EXAMPLE 2

EXAMPLE 3

EXAMPLE 4

TUNGSTEN CARBIDE-BASED CEMENTED HARD MATERIAL

FIELD AND BACKGROUND OF THE INVENTION

The present invention relates to a tungsten carbide-based cemented hard material, use of this material for a woodworking tool or forming tool, and also a woodworking tool having a working region composed of this cemented hard material and a forming tool having a working region composed of this material.

Tungsten carbide-based cemented hard materials are composite materials in which hard material particles formed at least predominantly by tungsten carbide form the predominant part of the composite material and interstices between the hard material particles are filled by a ductile metallic binder. Such cemented hard materials have been used for many years in a variety of fields, for example in cutting machining of metal, in wear parts, in woodworking tools, in forming tools, etc., because of their advantageous materials properties, in particular high hardness in combination with good fracture toughness. The demands made of the material when such cemented hard materials are employed in the various fields of use are very different. In particular, mainly a high hardness is of importance in some applications, while in other applications a very balanced combination of hardness and toughness is important and in still other applications a good corrosion resistance, for example, is also important.

Especially when such cemented hard materials are used in woodworking tools and forming tools, a high fracture toughness $K_{Ic}$ and a high transverse rupture strength TRS are critical in addition to a high hardness and good corrosion resistance of the cemented hard material.

SUMMARY OF THE INVENTION

It is an object of the present invention to provide an improved tungsten carbide-based cemented hard material which has, especially for use in woodworking tools or forming tools, a particularly advantageous combination of hardness, corrosion resistance, fracture toughness and transverse rupture strength, and also to provide an improved woodworking tool and an improved forming tool.

The object is achieved by a tungsten carbide-based cemented hard material as claimed. Advantageous embodiments are indicated in the dependent claims.

The cemented hard material comprises: tungsten carbide having an average particle size of 0.1-1.3 μm; 1.0-5.0% by weight of (Co+Ni), with a Co/(Co+Ni) ratio in % by weight of 0.4≤Co/(Co+Ni) 0.95; 0.1-1.0% by weight of Cr, with a ratio of Cr to (Co+Ni) in % by weight of 0.05≤Cr/(Co+Ni) ≤0.20; 0.01-0.3% by weight of Mo; and 0.02-0.45% by weight of Me, where Me=one or more elements from the group consisting of Ta, Nb, Hf and Ti, preferably Ta and/or Nb; and also 0.01≤Me/(Co+Ni)≤0.13.

The proportion of tungsten carbide in the cemented hard material can particularly preferably be from 92 to 98.5% by weight. Here, % by weight of (Co+Ni) means the total proportion of Co and Ni in percent by weight. The Me/(Co+Ni) ratio is also to be determined in percent by weight. The cemented hard material of the invention achieves an advantageous combination of high hardness, good corrosion resistance and at the same time a high fracture toughness and transverse rupture strength for the high hardness, which is particularly advantageous, especially for use in woodworking tools and forming tools. The advantageous properties are attributed to the combination of Co and Ni in the range indicated, the targeted addition of Cr and Mo in the ranges indicated and also the targeted addition of at least one of the elements Ti, Ta, Hf and Nb in the amount indicated. The cemented hard material thus comprises WC, Co, Ni, Cr and Mo together with at least one of the elements Ta, Nb, Hf and Ti, but can also comprise a plurality of these elements. The cemented hard material can preferably comprise Ta, Nb or Ta and Nb in combination. Unless indicated otherwise in the present description, amounts and ratios in each case relate to percent by weight of the constituents. Chromium can be added in powder-metallurgical production of the cemented hard material, e.g. as pure metal or in the form of $Cr_3C_2$ or $Cr_2N$ powder. Mo can preferably be added in the form of $Mo_2C$ powder, but addition as, for example, pure metal or, for example, as (W, Mo)C mixed carbide is also possible. The further element or elements can, for example, be added in particular as carbide MeC, thus TaC, NbC, etc., or as mixed carbide such as (Ta, Nb)C or (W, Me)C, in particular, for example, (W, Ta)C or, for example, (W, Ti, Ta, Nb)C, etc. The cemented hard material can further optionally comprise small amounts of vanadium of up to 0.2% by weight, preferably up to maximum 0.15% by weight. The cemented hard material can preferably have only the composition indicated and unavoidable impurities, i.e. consist essentially of the composition indicated.

In one embodiment, the cemented hard material has an average particle size of the tungsten carbide of 0.1-0.8 μm, which represents a particularly advantageous compromise between hardness and fracture toughness and also transverse rupture strength, especially for use in woodworking tools or forming tools. The cemented hard material can preferably have an average particle size of the tungsten carbide of 0.2-0.5 μm.

In one embodiment, the Co/(Co+Ni) ratio is such that: 0.6≤Co/(Co+Ni)≤0.9. At this ratio in particular, a good balance between good wetting of the tungsten carbide particles with the binder on the one hand and a high corrosion resistance and fracture toughness of the cemented hard material on the other hand is achieved.

In one embodiment, the Cr/(Co+Ni) ratio in % by weight is such that: 0.05≤Cr/(Co+Ni)≤0.15. In this range, in particular, the amount of Cr relative to the main binder constituents Co and Ni is such that high hardness and corrosion resistance are achieved but at the same time the process parameters in the production process are still sufficiently insensitive within conventional tolerances.

In one embodiment, the ratio of Mo to Cr in % by weight is such that: Mo/Cr<0.5; preferably Mo/Cr<0.4. The significantly higher proportion of Cr in the ratio to Mo has a positive effect on the compromise between hardness and corrosion resistance and secondly fracture toughness and transverse rupture strength.

In one embodiment, 0.02≤Me/(Co+Ni)≤0.08. Here too, the ratio is to be determined in % by weight. In this range in particular, the addition of one or more elements from among Ta, Nb, Hf and/or Ti has a positive effect on the materials properties. Particular preference is given to Me=Ta and/or Nb.

The ratio of Me to Cr in % by weight is preferably such that: Me/Cr<0.65. In particular, Me/Cr can be >0.05 in order to achieve a sufficient influence of the additional addition but on the other hand avoid disadvantageous effects.

In one embodiment, the cemented hard material has a Vickers hardness HV10 in the range from 2050 to 2450. Such a high hardness is advantageous especially for use in a woodworking tool or a forming tool. The Vickers hardness HV10 in accordance with ISO 3878:1991 ("Hardmetals—Vickers hardness test") is particularly preferably in the range $$HV10=2550-100\cdot\%\text{ by weight of }(Co+Ni)\pm150.$$

In one embodiment, the cemented hard material has a fracture toughness $K_{IC}$ in the range from 7.1 to 8.5 $MPa\cdot m^{1/2}$. The measurement is carried out in accordance with ISO 28079:2009 using an indentation load of 10 kgf (corresponding to 98.0665 N). The fracture toughness $K_{IC}$ in $MPa\cdot m^{1/2}$ can, in particular, be in the range $$K_{IC}=6.8+(1/3)\cdot\%\text{ by weight of }(Co+Ni)\pm\pm0.5,$$

preferably in the range $$K_{IC}=6.8+(1/3)\cdot\%\text{ by weight of }(Co+Ni)\pm0.3.$$

In one embodiment, the cemented hard material has a transverse rupture strength in the range from 2560 MPa to 4230 MPa. The transverse rupture strength is determined in accordance with the standard ISO 3327:2009 using a test specimen having a cylindrical cross section (shape C). The transverse rupture strength in MPa can, in particular, be in the range:

$$TRS=2150+(2500/6)\cdot\%\text{ by weight of }(Co+Ni)\pm500,$$

preferably in the range:

$$TRS=2150+(2500/6)\cdot\%\text{ by weight of }(Co+Ni)\pm300.$$

The object is also achieved by the use of the cemented hard material for a woodworking tool or a forming tool as claimed.

The object is also achieved by a woodworking tool as claimed having a working region which is made of such a tungsten carbide-based cemented hard material.

The object is also achieved by a forming tool as claimed having a working region which is made of such a tungsten carbide-based cemented hard material.

In one embodiment, the forming tool is a tool for cold forming, in particular a drawing die for wire production or a deep-drawing tool.

Further advantages and useful aspects of the invention may be derived from the following description of working examples with reference to the accompanying figures.

ILLUSTRATIVE EMBODIMENT

Figure 1:
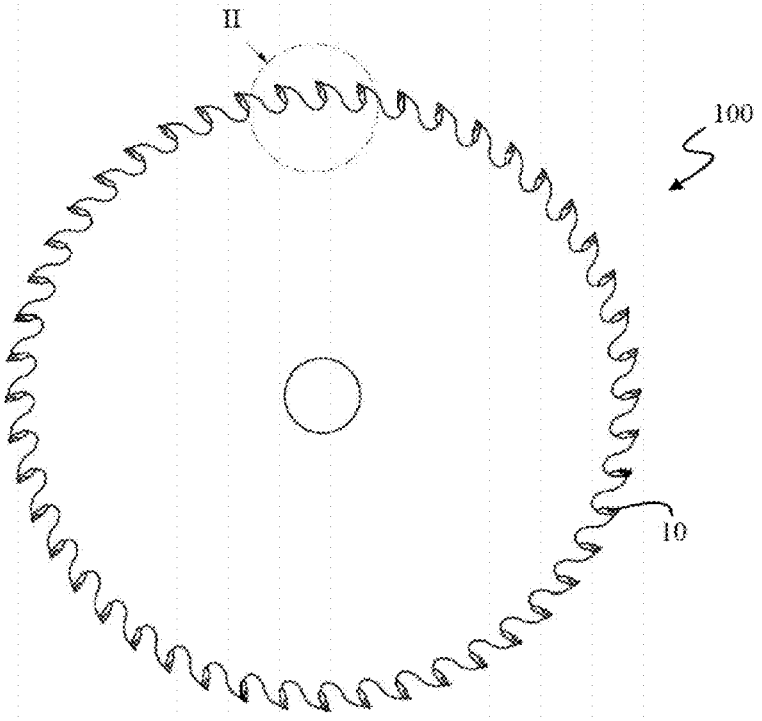
FIG. 1: a schematic depiction of a woodworking tool having a working region composed of a cemented hard material according to one illustrative embodiment.

An illustrative embodiment of the tungsten carbide-based cemented hard material will firstly be described in general terms below.

The cemented hard material has a specific composition which will be described in more detail below.

The cemented hard material consists predominantly of tungsten carbide having an average particle size in the range 0.1-1.3 μm. The average particle size can preferably be in the range 0.1-0.8 μm. The average particle size is particularly preferably in the range 0.2-0.5 μm.

The proportion of tungsten carbide in the cemented hard material can be, in particular, from 92 to 98.5% by weight. The cemented hard material additionally comprises a ductile metallic binder. In the illustrative embodiment, the metallic binder consists predominantly of Co (cobalt) and Ni (nickel), with the ratio in percent by weight of Co to the sum of Co and Ni being in the range from 0.4 to 0.95. The ratio is preferably in the range from 0.6 to 0.9; i.e. the proportion of Co in the metallic binder is preferably greater than the proportion of Ni in the metallic binder.

The tungsten carbide-based cemented hard material further comprises from 0.1 to 1% by weight of Cr, with the ratio of Cr to the sum of Co and Ni in percent by weight being selected so that $0.05\leq Cr/(Co+Ni)\leq0.20$. When the Cr content is kept within this range, the desired grain-refining effect is achieved and chromium-containing mixed carbide precipitates can be largely avoided. Preference is given to: $0.05\leq Cr/(Co+Ni)\leq0.15$. In this case, chromium-containing mixed carbide precipitates can be avoided particularly reliably without the production parameters in the powder-metallurgical production process having to be kept within narrow tolerance ranges.

The cemented hard material of the illustrative embodiment also additionally comprises 0.01-0.3% by weight of Mo. The Mo content is preferably set so that it is significantly lower than the Cr content, preferably less than half the Cr content, particularly preferably less than 40% of the Cr content.

According to the invention, the cemented hard material further comprises one or more elements from the group consisting of Ta, Nb, Hf and Ti, with the total proportion in the cemented hard material being in the range from 0.02 to 0.45 percent by weight. The ratio of the total proportion of Ta, Nb, Hf and Ti to the total proportion of Co and Ni is in the range from 0.01 to 0.13. The ratio can particularly preferably be in the range from 0.02 to 0.08. The cemented hard material can preferably comprise only Ta and/or Nb from the group consisting of Ta, Nb, Hf and Ti, which two elements have a particularly positive effect on the physical properties of the cemented hard material. The total proportion of the further elements of the group consisting of Ta, Nb, Hf and Ti in the cemented hard material can preferably be significantly smaller than the proportion of Cr in the cemented hard material, in particular less than 65% of the Cr content. Optionally, the cemented hard material can comprise additionally up to maximum 0.2% by weight vanadium, preferably up to maximum 0.15% by weight.

The cemented hard material as per the illustrative embodiment was produced powder-metallurgically using WC powder having a particle size (FSSS, Fisher sieve sizes) of 0.5 μm; Co powder having an FSSS particle size of 0.9 μm, Ni powder having an FSSS particle size of 2.5 μm, $Cr_3C_2$ powder having an FSSS particle size of 1.5 μm; $Mo_2C$ powder having an FSSS particle size of 1.35 μmm; NbC powder having an FSSS particle size of 1.2 μm, TaC powder having an FSSS particle size of 0.9 μm and (Ta, Nb)C powder (more precisely: $(Ta_{0.6}, Nb_{0.4})C$ powder) having an FSSS particle size of 1.2 μm. Production was carried out by mixing of the respective starting powders with a solvent in a ball mill or an attritor and subsequent spray drying in the customary way. The resulting granular material was pressed and brought to the desired shape and was subsequently sintered in a conventional way in order to obtain the cemented hard material. Drawing dies for steel wire as working region for a forming tool and saw teeth as working region for a woodworking tool in the form of a circular saw were manufactured from the cemented hard material. The determination of the average grain size of the tungsten carbide grains in the cemented hard material was carried out by the "equivalent circle diameter (ECD)" method from EBSD (electron backscatter diffraction) images. This method is described, for example, in "Development of a quantitative method for grain size measurement using EBSD"; Master of Science Thesis, Stockholm 2012, by Frederik Josefsson.

A first illustrative embodiment of a woodworking tool 100 having a working region 10 made of the tungsten carbide-based cemented hard material as has been described above is depicted in FIG. 1 and FIG. 2.

In the illustrative embodiment specifically depicted, the woodworking tool 100 is a circular saw blade which has a plurality of saw teeth which each form a working region 10 which engages with the wood to be worked. The working region 10 composed of the cemented hard material in the form of the saw tooth is in each case metallurgically bonded, e.g. via a solder joint, to the main element 11 of the circular saw blade, which can, for example, be made of steel in the conventional way.

Figure 2:
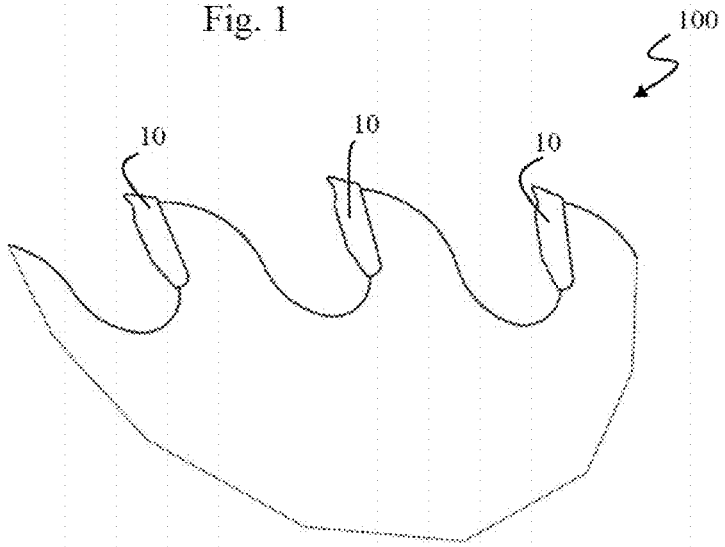
FIG. 2: an enlarged schematic depiction of a detail II of FIG. 1.

Although a circular saw blade is depicted by way of example as woodworking tool in FIG. 1 and FIG. 2, the tungsten carbide-based cemented hard material can also be used as working region on other woodworking tools.

An illustrative embodiment of a forming tool 200 having a working region 20 made of the tungsten carbide-based cemented hard material as has been described above is depicted in FIG. 3 to FIG. 5.

Figure 3:
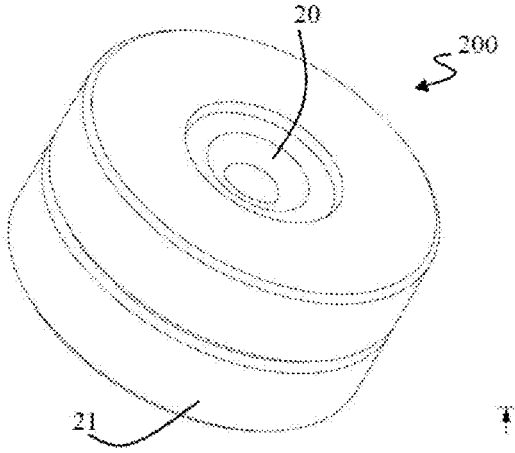
FIG. 3: a schematic depiction of a forming tool having a working region composed of a cemented hard material according to another illustrative embodiment.
Figure 4:
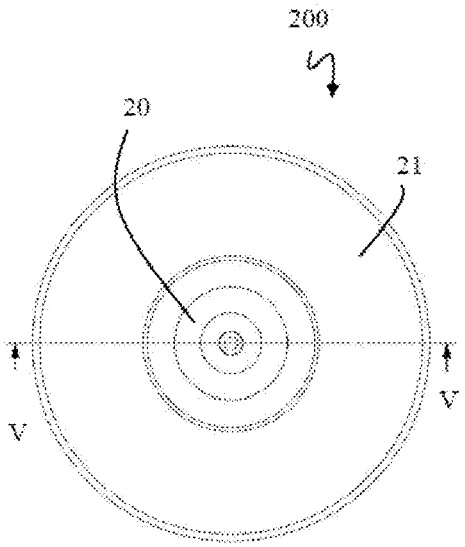
FIG. 4: a schematic plan of the forming tool of FIG. 3.
Figure 5:
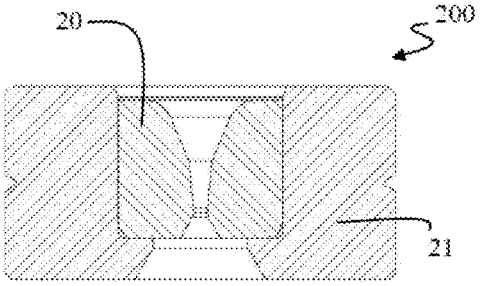
FIG. 5: a schematic cross-sectional view of the forming tool of FIG. 3.

In the illustrative embodiment specifically depicted in FIG. 3 to FIG. 5, the forming tool 200 is a tool for cold forming, in particular a drawing die for wire production, and the working region 20 is a draw plate which comes into direct contact with the material to be worked, e.g. steel wire. The working region 20 composed of the cemented hard material is accommodated in a housing 21 which can, for example, be made of steel.

EXAMPLES

Comparative Example 1

Figure 6:
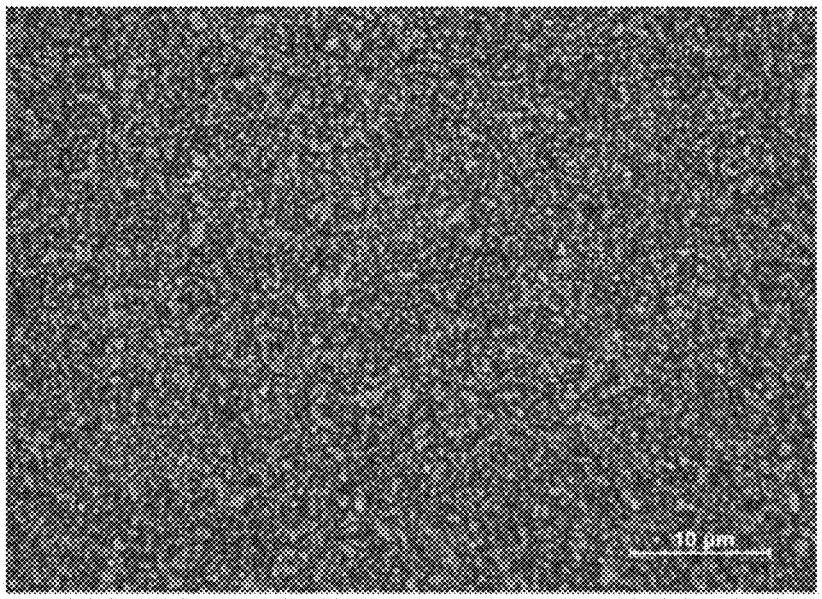
FIG. 6: an optical micrograph of a cemented hard material as per comparative example 1.

As comparative example, a tungsten carbide-based cemented hard material was produced by the powder-metallurgical process indicated above using the following composition: 2.25% by weight of Co; 0.75% by weight of Ni; 0.35% by weight of Cr (corresponds to 0.4% by weight of $Cr_3C_2$ as starting material); 0.047% by weight of Mo (corresponds to 0.05% by weight of $Mo_2C$ as starting material), balance WC and unavoidable impurities. The proportion of WC is thus about 96.55% by weight. An optical micrograph of the microstructure of this cemented hard material is shown in FIG. 6.

In the production process, the carbon balance was set so that the resulting cemented hard material is at least substantially free of η phase, i.e. of undesirable $(W_x, Co_y)_zC$ mixed phases, and substantially free of carbon precipitates. In this context, substantially free of η phase means that from 0 to not more than 0.5% by volume of η phase is present.

The average grain size of the tungsten carbide grains was in the range 0.2-0.5 μm. A Vickers hardness HV10 of 2140, a fracture toughness $K_{IC}$ of 7.8 $MPa \cdot m^{1/2}$ and a transverse rupture strength of 3200 MPa were measured.

Example 1

Figure 7:
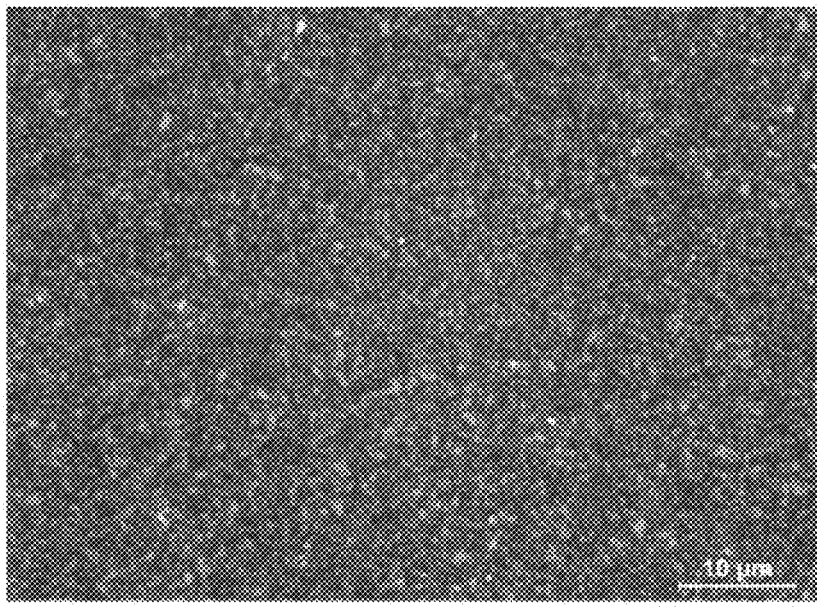
FIG. 7: an optical micrograph of a cemented hard material as per Example 1.

A tungsten carbide-based cemented hard material was produced by the above-described powder-metallurgical production process using the following composition: 2.7% by weight of Co; 0.9% by weight of Ni; 0.45% by weight of Cr (corresponds to 0.52% by weight of $Cr_3C_2$ as starting material); 0.047% by weight of Mo (corresponds to 0.05% by weight of $Mo_2C$ as starting material) and 0.094% by weight of Ta (corresponds to 0.1% by weight of TaC as starting material), balance WC and unavoidable impurities. The proportion of WC was thus about 95.73% by weight. The content of Co+Ni was 3.6% by weight, with a Co/(Co+Ni) ratio of 0.75. The Cr/(Co+Ni) ratio was 0.125. The Me/(Co+Ni) ratio was 0.026; with Me=Ta in this Example 1. An optical micrograph of the microstructure of the cemented hard material is shown in FIG. 7.

In this example, too, the carbon balance was set in the production process so that the resulting cemented hard material is at least substantially free of η phase, i.e. of undesirable $(W_x, Co_y)_zC$ mixed phases, and substantially free of carbon precipitates.

The average grain size of the tungsten carbide grains in the cemented hard material was in the range from 0.2 to 0.5 μm. The Vickers hardness HV10 was (in accordance with ISO 3878:1991) determined and was 2145. The fracture toughness $K_{IC}$ was also determined as described above and was 8.0 $MPa \cdot m^{1/2}$. The determination of the transverse rupture strength by the method indicated above gave 3650 MPa.

It can thus be seen that the tungsten carbide-based cemented hard material of Example 1 has both a higher fracture toughness $K_{IC}$ and a higher transverse rupture strength compared to the cemented hard material of Comparative Example 1 at a comparable hardness HV10.

Example 2

Figure 8:
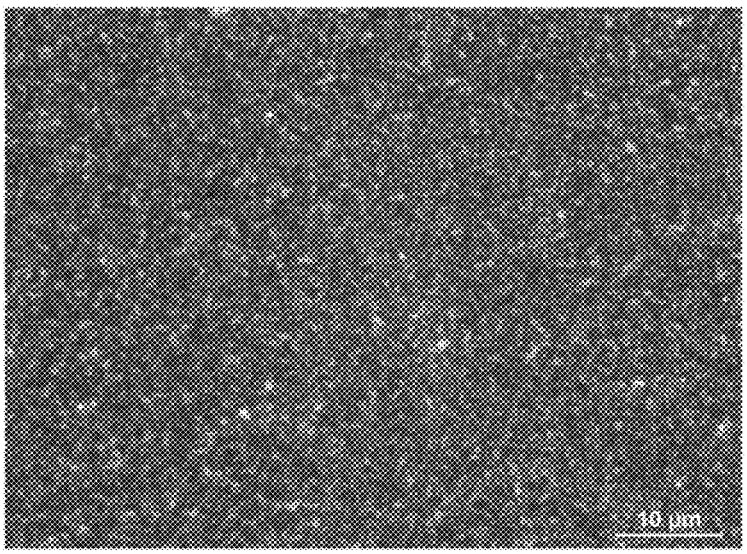
FIG. 8: an optical micrograph of a cemented hard material as per Example 2.

A tungsten carbide-based cemented hard material was produced by the above-described powder-metallurgical production process using the following composition: 3.15% by weight of Co; 1.05% by weight of Ni; 0.83% by weight of Cr (corresponds to 0.96% by weight of $Cr_3C_2$ as starting material); 0.132% by weight of Mo (corresponds to 0.14% by weight of $Mo_2C$ as starting material) and 0.188% by weight of Ta (corresponds to 0.2% by weight of TaC as starting material), balance WC and unavoidable impurities. The proportion of WC was thus about 94.50% by weight. The content of Co+Ni was 4.2% by weight, with a Co/(Co+Ni) ratio of 0.75. The Cr/(Co+Ni) ratio was 0.198. The Me/(Co+Ni) ratio was 0.045; with Me=Ta in this Example 2 as well. An optical micrograph of the cemented hard material is shown in FIG. 8.

In this example, too, the carbon balance was set so that the cemented hard material was substantially free of ƒ phase and free of carbon precipitates.

The average grain size of the tungsten carbide grains was in the range 0.2-0.5 μm. A Vickers hardness HV10 of 2180, a fracture toughness $K_{IC}$ of 8.1 MPa·m$^{1/2}$ and a transverse rupture strength of 3800 MPa were measured.

It can thus be seen that the cemented hard material of Example 2 has both a higher fracture toughness $K_{IC}$ and a higher transverse rupture strength compared to comparative example 1 at a higher hardness HV10.

Example 3

Figure 9:
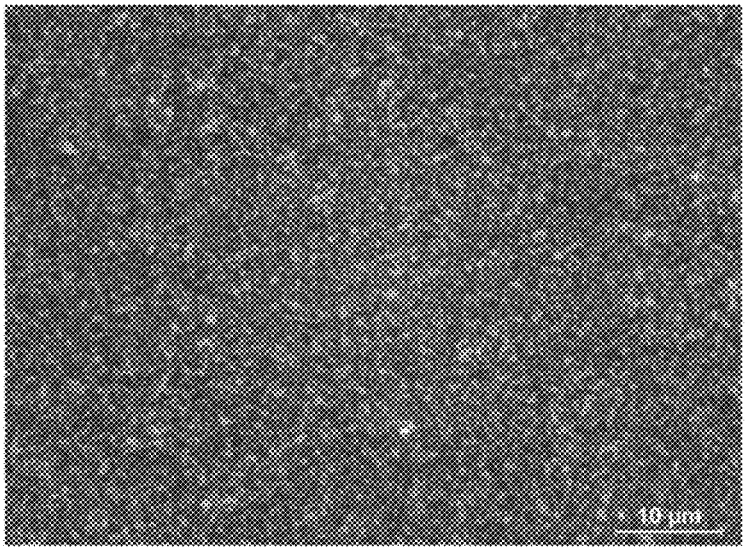
FIG. 9: an optical micrograph of a cemented hard material as per Example 3.

A tungsten carbide-based cemented hard material was produced by the above-described power-metallurgical production process using the following composition: 2.7% by weight of Co; 0.9% by weight of Ni; 0.45% by weight of Cr (corresponds to 0.52% by weight of $Cr_3C_2$ as starting material); 0.094% by weight of Mo (corresponds to 0.1% by weight of $Mo_2C$ as starting material) and 0.177% by weight of Nb (corresponds to 0.2% by weight of NbC as starting material), balance WC and unavoidable impurities. The proportion of WC was thus about 95.58% by weight. In this example 3, Me was thus Nb. An optical micrograph of the cemented hard material is shown in FIG. 9.

In this example, too, the carbon balance was set so that the cemented hard material was substantially free of η phase and free of carbon precipitates.

The average grain size of the tungsten carbide grains was in the range 0.2-0.5 μm. A Vickers hardness HV10=2235, a fracture toughness $K_{IC}$ of 7.9 MPa·m$^{1/2}$ and a transverse rupture strength of 3600 MPa were measured.

It can thus be seen that the cemented hard material of Example 3 has both a higher fracture toughness $K_{IC}$ and a higher transverse rupture strength compared to comparative example 1 at a significantly higher hardness HV10.

Example 4

Figure 10:
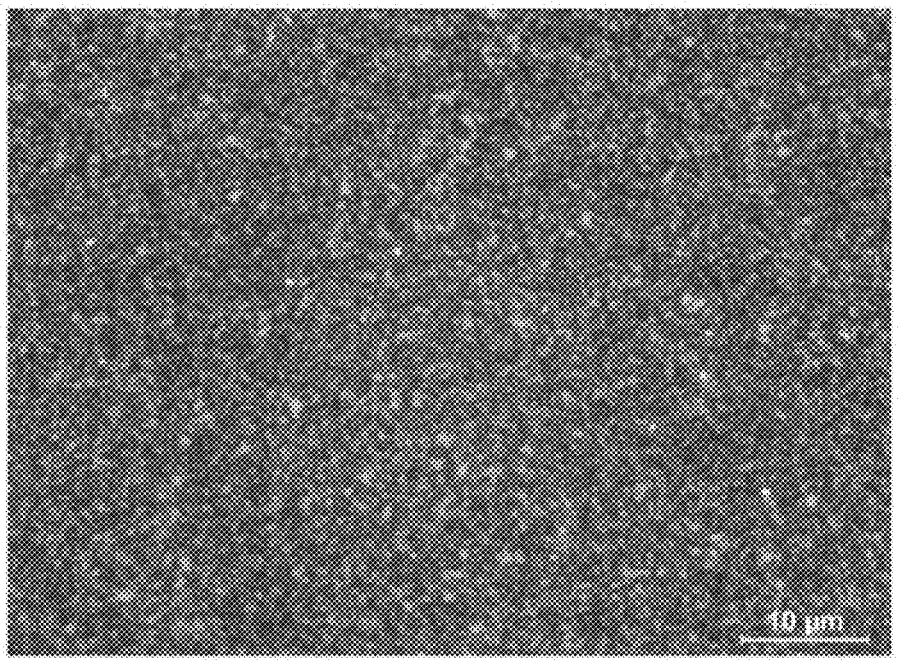
FIG. 10: an optical micrograph of a cemented hard material as per Example 4.

A tungsten carbide-based cemented hard material was produced by the above-described powder-metallurgical reduction process using the following composition: 2.7% by weight of Co; 0.9% by weight of Ni; 0.45% by weight of Cr (corresponds to 0.52% by weight of $Cr_3C_2$ as starting material); 0.094% by weight of Mo (corresponds to 0.10% by weight of $Mo_2C$ as starting material), 0.113% by weight of Ta (corresponds to 0.2% by weight of (Ta, Nb)C as starting material) and 0.071% by weight of Nb (corresponds to 0.2% by weight of (Ta, Nb)C as starting material), balance WC and unavoidable impurities. The proportion of WC was thus about 95.58% by weight. The content of Co+Ni was 3.6% by weight, with a Co/(Co+Ni) ratio of 0.75. The Cr/(Co+Ni) ratio was 0.125. The Me/(Co+Ni) ratio was 0.051; with Me=Ta+Nb in this Example 4. An optical micrograph of the microstructure of this cemented hard material is shown in FIG. 10.

In this example, too, the carbon balance was set so that the cemented hard material was substantially free of η phase and free of carbon precipitates.

The average grain size of the tungsten carbide grains in the cemented hard material was in the range from 0.2 to 0.5 μm. The Vickers hardness HV10 was (in accordance with ISO 3878:1991) determined and was 2220. The fracture toughness $K_{IC}$ was also determined as described above and was 7.9 MPa·m$^{1/2}$. The determination of the transverse rupture strength by the method indicated above gave 3500 MPa.

It can thus be seen that the cemented hard material of Example 4 has both a higher fracture toughness $K_{IC}$ and a higher transverse rupture strength compared to comparative example 1 at a significantly higher hardness HV10.

The invention claimed is:

1. A tungsten carbide-based cemented hard material, comprising:

tungsten carbide having an average particle size of 0.1-1.3 μm;

3.6-5.0% by weight of (Co+Ni), with a ratio of Co to (Co+Ni) in % by weight of $0.4 \leq Co/(Co+Ni) \leq 0.95$;

0.1-1.0% by weight of Cr, with a ratio of Cr to (Co+Ni) in % by weight of $0.05 \leq Cr/(Co+Ni) \leq 0.20$;

0.01-0.3% by weight of Mo; and 0.02-0.45% by weight of Me, where Me is one or more elements selected from the group consisting of Ta, Nb, Hf and Ti; and $0.01 \leq Me/(Co+Ni) \leq 0.13$.

2. The tungsten carbide-based material according to claim 1, wherein Me is at least one of Ta or Nb.

3. The tungsten carbide-based material according to claim 1, wherein the tungsten carbide has an average particle size of 0.1-0.8 μm.

4. The tungsten carbide-based material according to claim 3, wherein the tungsten carbide has an average particle size of 0.2-0.5 μm.

5. The tungsten carbide-based material according to claim 1, wherein $0.6 \leq Co/(Co+Ni) \leq 0.9$.

6. The tungsten carbide-based material according to claim 1, wherein $0.05 \leq Cr/(Co+Ni) \leq 0.15$.

7. The tungsten carbide-based material according to claim 1, wherein a ratio of Mo to Cr in % by weight is Mo/Cr<0.5.

8. The tungsten carbide-based material according to claim 7, wherein the ratio Mo/Cr<0.4.

9. The tungsten carbide-based material according to claim 1, wherein $0.02 \leq Me/(Co+Ni) \leq 0.08$.

10. The tungsten carbide-based material according to claim 1, wherein a ratio of Me to Cr in % by weight is Me/Cr<0.65.

11. The tungsten carbide-based material according to claim 1, having a hardness HV10 in a range given by the equation:

$$HV10=2550-100\cdot\%\text{ by weight of }(Co+Ni)\pm150.$$

12. The tungsten carbide-based material according to claim 1, having a fracture toughness $K_{IC}$ in MPa·m$^{1/2}$ in a range $$K_{IC}=6.8+(1/3)\cdot\%\text{ by weight of }(Co+Ni)\pm0.5.$$

13. The tungsten carbide-based material according to claim 1, having a transverse rupture strength TRS in MPa in a range:

$$TRS=2150+(2500/6)\cdot\%\text{ by weight of }(Co+Ni)\pm500.$$

14. A woodworking tool, comprising a working region made of a tungsten carbide-based cemented hard material according to claim 1.

15. A forming tool, comprising a working region made of a tungsten carbide-based cemented hard material according to claim 1.

16. The forming tool according to claim 15, configured as a tool for cold forming.

17. The forming tool according to claim 16, being a drawing die for wire production or a deep-drawing tool.

* * * * *